US005203414A

United States Patent [19]

Hromas et al.

[11] Patent Number: 5,203,414

[45] Date of Patent: Apr. 20, 1993

[54] METHOD OF ANCHORING A DEVICE IN A WELLBORE INCLUDING OPENING AN ORIFICE BETWEEN TWO CHAMBERS IN RESPONSE TO AN ELECTRICAL SIGNAL AND MOVING A PISTON IN RESPONSE TO HYDROSTATIC PRESSURE WHEN THE ORIFICE IS OPENED

[75] Inventors: Joe C. Hromas, Sugar Land; A. Glen Edwards, Hockley; Klaus B. Huber, Sugar Land, all of Tex.

[73] Assignee: Schlumberger Technology Corporation, Houston, Tex.

[21] Appl. No.: 872,273

[22] Filed: Apr. 22, 1992

Related U.S. Application Data

[62] Division of Ser. No. 670,554, Mar. 15, 1991, Pat. No. 5,146,983.

[51] Int. Cl.[5] ..... E21B 23/04

[52] U.S. Cl. ..... 166/382; 166/383

[58] Field of Search ..... 166/382, 383, 212, 123, 166/120, 654, 317, 332, 63, 316, 100, 72

[56] References Cited

U.S. PATENT DOCUMENTS

| | | | |
|---|---|---|---|
| 2,770,308 | 11/1956 | Saurenman | 166/72 X |
| 2,979,904 | 4/1961 | Royer | 166/123 X |
| 3,125,162 | 3/1964 | Briggs, Jr. et al. | 166/123 |
| 3,208,355 | 9/1965 | Baker et al. | 166/63 X |
| 4,493,374 | 1/1985 | Magee, Jr. | 166/382 |
| 4,535,842 | 8/1985 | Ross | 166/383 X |

FOREIGN PATENT DOCUMENTS

| | | | |
|---|---|---|---|
| 1286735 | 1/1987 | U.S.S.R. | 166/123 |

*Primary Examiner*—Hoang C. Dang

*Attorney, Agent, or Firm*—Henry N. Garrana; John H. Bouchard

[57] ABSTRACT

A hydrostatic setting tool, adapted for setting an anchored device in a wellbore, includes a housing having a pair of ports exposed to well fluid at hydrostatic pressure. The ports lead to a shoulder of a setting mandrel. A barrier is disposed diametrically across the setting tool and an oil chamber is disposed between the setting mandrel and the barrier. The barrier includes an oil metering orifice disposed through a center thereof. A selectively operable apparatus, initially disposed in a closed position and blocking the oil metering orifice, is adapted to change from the closed position to an open position in response to a current delivered thereto from the well surface. An air chamber is disposed on the other side of the barrier. The well fluid places hydrostatic pressure on the shoulder of the setting mandrel thereby placing the same pressure on the oil in the oil chamber. When the current is delivered to the selectively operable apparatus blocking the oil metering orifice, the apparatus changes from the closed position to an open position thereby opening the oil metering orifice and allowing the oil in oil chamber, at hydrostatic pressure, to transfer to the air chamber via the orifice. This allows the setting mandrel to move in the setting tool thereby setting the anchored device. A tension sleeve shears off, at a point near the anchored device, in response to continued movement of the setting mandrel thereby disconnecting the setting tool from the anchored device.

10 Claims, 4 Drawing Sheets

METHOD OF ANCHORING A DEVICE IN A WELLBORE INCLUDING OPENING AN ORIFICE BETWEEN TWO CHAMBERS IN RESPONSE TO AN ELECTRICAL SIGNAL AND MOVING A PISTON IN RESPONSE TO HYDROSTATIC PRESSURE WHEN THE ORIFICE IS OPENED

This is a division of application Ser. No. 07/670,554 filed Mar. 15, 1991, now the U.S. Pat. No. 5,146,983.

BACKGROUND OF THE INVENTION

The subject matter of the present invention relates to a setting tool used in association with downhole apparatus disposed in a wellbore, and more particularly, to a setting tool which is adapted for setting an anchor or other downhole device in response to the hydrostatic pressure of an annulus fluid disposed in the annulus section of a wellbore, the setting tool moving a piston and forcing oil to transfer from an oil chamber to an air chamber through an oil metering orifice in response to the hydrostatic pressure of the annulus fluid, the orifice including an apparatus for selectively allowing the oil to transfer through orifice in response to a current delivered to the apparatus from a user at the well surface.

In the life of every oil well, anchoring of various pieces of downhole equipment is commonplace. Common types of anchored downhole equipment include permanent production packers, testing or retrievable packers, bridge plugs, cement retainers, pressure gauge-/instrument hangers, and perforating guns. These devices are anchored in a well to the casing by expanding slips, the slips being expanded by relative opposing motion of a mandrel to a fixed point in the device. The relative motion, normally compression, moves slips radially outward. The slips have either hardened wicker teeth or carbide inserts to bite into the casing, and hold the anchored device stationary. The anchored devices can be actuated in several ways; for example, by rotary motion and tension of drill pipe/tubing, compressive set down weight accomplished by slacking of pipe/tubing weight, or by a setting tool run on electric cable which creates its own relative motion, independent of outside mechanical means.

The subject invention is such a setting tool. There are many kinds of setting tools for downhole equipment Most are unique to the type of downhole equipment that they set. For electric wireline conveyed setting tools, the most common kind of setting tool is activated by electric current conveyed through the wireline, the electric current igniting a flammable solid in the tool. A gas is created by the burning of the flammable solid, the pressure of the gas causing the setting tool to linearly expand, the expansion causing relative opposing axial motion to occur between the setting tool outer housing and its inner mandrel. The relative motion compresses an anchor/packer and wedges the slips of the anchor/-packer against a wellbore casing wall. When the wedging force of the slips against the casing reaches a predetermined value, a tension sleeve or stud, which connects the setting tool to an anchored device, breaks. The anchored device and setting tool separate, leaving the anchored device downhole, allowing the setting tool to be retrieved to the surface via the wireline cable. When setting packers with elastomeric sealing elements, it is desirable to set at a slower rate of speed. This allows the elastomeric sealing elements time to expand and to conform to new shapes without damage, thereby assuring reliability. Wireline setting tools normally control the speed of the setting of the packers by utilizing the timed build-up of gas pressure from the burned flammable solid to force oil through an orifice. The rate of speed is regulated by gas pressure, fluid viscosity, and orifice size. However, the oil is forced through the orifice in response to a build-up of gas pressure from the flammable solid, not in response to other means, such as a hydrostatic pressure of an annulus fluid disposed in a wellbore annulus. The major disadvantage associated with reliance on gas pressure to actuate the tool involves a reduction is gas pressure as the setting tool expands and as the gas cools, thereby reducing setting load. In addition, when the oil is forced through the orifice, there exists no separate selective means in the orifice for initially maintaining the orifice closed thereby preventing the oil from traversing through the orifice and subsequently selectively opening the orifice thereby allowing the oil to traverse through the orifice.

SUMMARY OF THE INVENTION

Accordingly, it is a primary object of the present invention provide a setting tool adapted to be disposed in a wellbore which produces a relative axial motion between a setting mandrel of the tool and an outer housing of the tool in response to the hydrostatic pressure of a well annulus fluid disposed in an annulus section between the setting tool and a tubing or the setting tool and a casing.

It is a further object of the present invention to provide a setting tool which forces oil to transfer between an oil chamber and an air chamber in a controlled manner via an oil metering orifice in response to the relative axial motion between the setting mandrel and the outer housing of the tool.

It is a further object of the present invention to provide a setting tool which includes a selectively operable apparatus disposed in and blocking the oil metering orifice, the selectively operable apparatus being initially maintained in a closed position thereby preventing the oil from transfering between the oil chamber and the air chamber and preventing the setting mandrel from moving relative to the outer housing of the tool, the selectively operable apparatus subsequently changing from the closed position to an open position thereby allowing the oil to transfer between the oil chamber and the air chamber and allowing the setting mandrel to move relative to the outer housing in response to a current delivered to the apparatus from a user disposed at the well surface.

These and other objects of the present invention are accomplished by providing an electric wireline conveyed setting tool which includes a setting housing that contains a setting mandrel including a tension sleeve connected to the anchored device responsive to the hydrostatic of well annulus fluid, a piston responsive to movement of the setting mandrel, a first barrier means including an oil metering orifice disposed diametrically across a first portion of the setting housing thereby defining an oil chamber between the first barrier means and the piston, the oil chamber containing oil at hydrostatic pressure, and a second barrier means disposed diametrically across a second portion of the setting housing thereby defining an air chamber, filled with air at atmospheric pressure, between the second barrier means and the first barrier means. A selectively operable apparatus blocks the oil metering orifice. The selectively operable apparatus is initially disposed in a closed position thereby preventing oil from transferring between the oil chamber and the air chamber, the selectively operable apparatus subsequently changing to an open position thereby allowing the oil to transfer between the oil chamber and the air chamber in response to a current delivered to the selectively operable apparatus from a user at the well surface. In operation, the setting mandrel moves in response to hydrostatic pressure of the well annulus fluid thereby moving the piston. The piston movement compresses the oil in the oil chamber to a pressure equal to the hydrostatic pressure of the well annulus fluid. When the current is delivered to the selectively operable apparatus, the oil metering orifice is opened. As a result, the oil transfers from the oil chamber to the air chamber. During the oil transfer to the air chamber, the piston and the setting mandrel move in response to the hydrostatic pressure of the well annulus fluid. Since the tension sleeve of the anchored device is connected to a setting tool mandrel, movement of the setting mandrel sets the anchor of the anchored device, the anchored device being anchored to the wellbore casing. Eventually, the tension sleeve of the anchored device separates in response to further movement of the setting mandrel thereby allowing the setting tool to be retrieved from the wellbore and leaving the anchored device anchored to the wellbore casing. The selectively operable apparatus may comprise one of three different implementations: it may be a hydropuncture operator including a puncture needle, a solenoid, and a rupture disc adapted to rupture when the needle punctures the disc in response to a current delivered to the solenoid; it may be a piston held firmly in place by solder and a retaining ring, the solder and ring releasing the piston thereby opening the orifice in response to heat generated by a heater disposed around the retaining ring; or it may be a bolt adapted to separate along a recess thereby opening the orifice in response to a tension load induced in the bolt by a shape memory alloy element which expands in accordance with heat produced by a enclosed heater element.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

Figure 1:
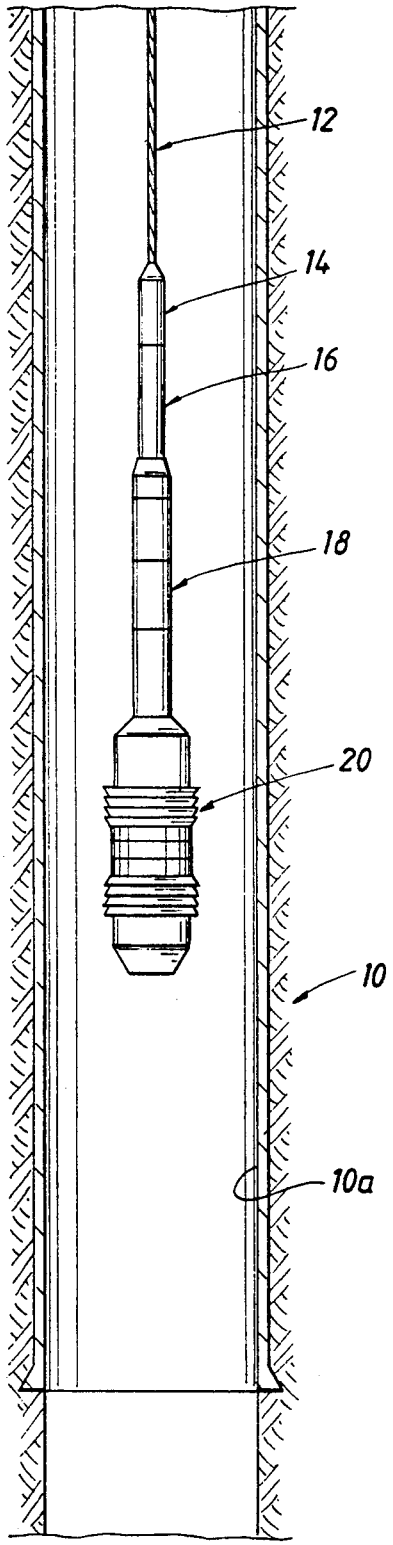
FIG. 1 illustrates a tool string disposed in a wellbore, the tool string including the setting tool of the present invention.
Figure 3:
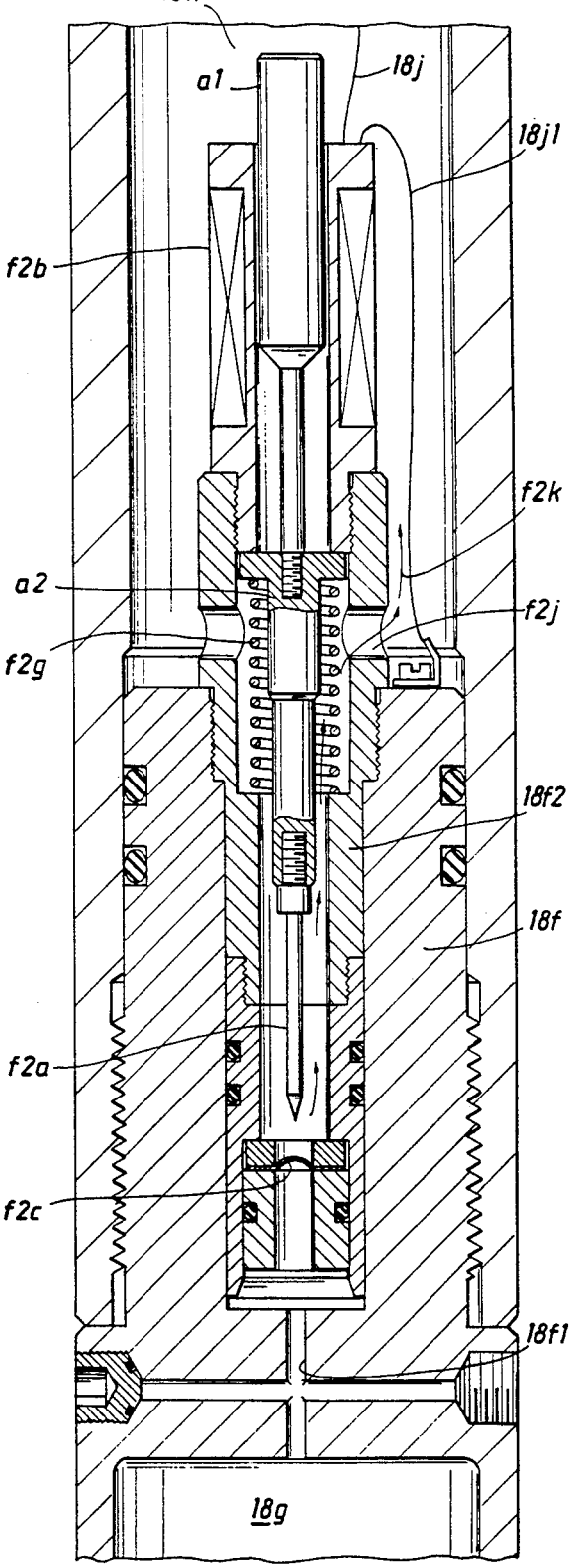
Figure 4:
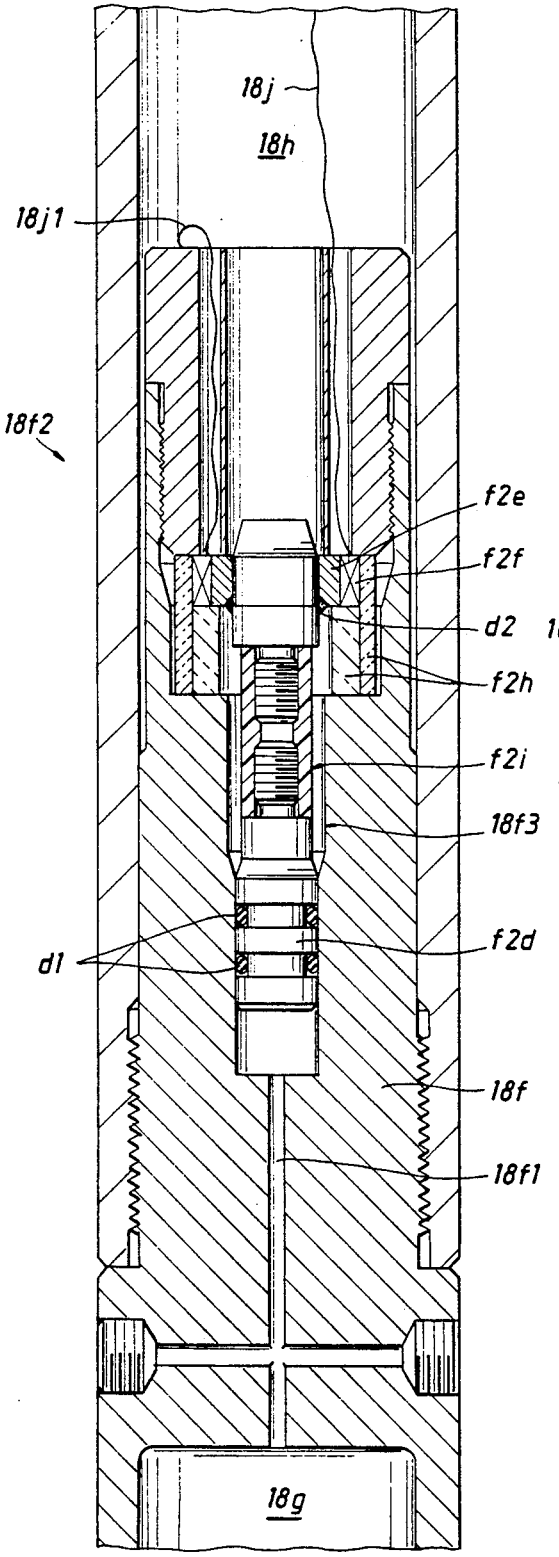
Figure 5:
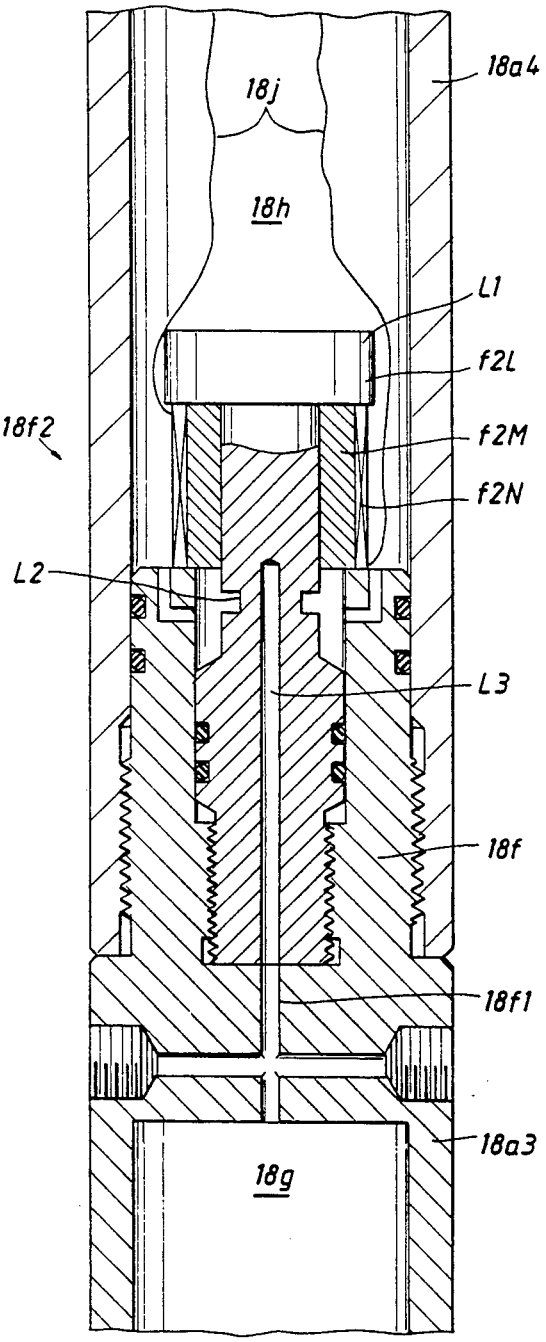

FIGS. *2a–2d* illustrate a detailed construction of the setting tool of FIG. 1 in accordance with the present invention including a detailed construction of its connection to the anchored device;

FIG. 3 illustrates a detailed construction of one embodiment of a selectively operable apparatus disposed between an air chamber and an oil chamber of the setting tool of FIG. *2b*, the selectively operable apparatus in FIG. *2b* being a hydropuncture operator;

FIG. 4 illustrates another alternate embodiment of the selectively operable apparatus disposed between the air chamber and the oil chamber of the setting tool of FIG. *2b*, the selectively operable apparatus including a piston held firmly in place by a retaining ring and solder surrounded by a heater element; and FIG. 5 illustrates still another alternate embodiment of the selectively operable apparatus disposed between the air chamber and the oil chamber of the setting tool of FIG. *2b*.

DETAILED DESCRIPTION OF THE PREFERRED EMBODIMENT

Referring to FIG. 1, a tool string is disposed in a wellbore 10. The tool string is connected to an electric wireline 12 and includes a cable head 14, a casing collar locator (CCL) 16, a hydrostatic setting tool 18 in accordance with the present invention, and an anchored device 20 which may be either an anchor or a packer. The hydrostatic setting tool 18 sets the anchored device 20, anchoring the device 20 to the casing 10*a* of the borehole 10, in response to a current delivered to the setting tool 18 via the wireline 12.

Referring to FIGS. *2a–2d*, a detailed construction of the hydrostatic setting tool 18 of the present invention is illustrated, including a construction of its connection to the anchored device 20.

Beginning with FIG. *2d*, the setting tool 18 includes a setting housing 18*a* within which the various components of the setting tool are disposed. A first setting mandrel 18*b* is disposed within the setting housing 18*a*. One end of the first setting mandrel 18*b* is attached to an adaptor body 18*b*2, the adaptor body 18*b*2 being attached to a tension sleeve 20*a*. The tension sleeve 20*a* is adapted to be connected to the anchored device 20 and is adapted to shear off along a recess portion 20*b* when the tension sleeve 20*a* is connected to the anchored device 20 in the wellbore and an upward force placed on the tension sleeve 20*a* exceeds a predetermined value.

Figure 2A:
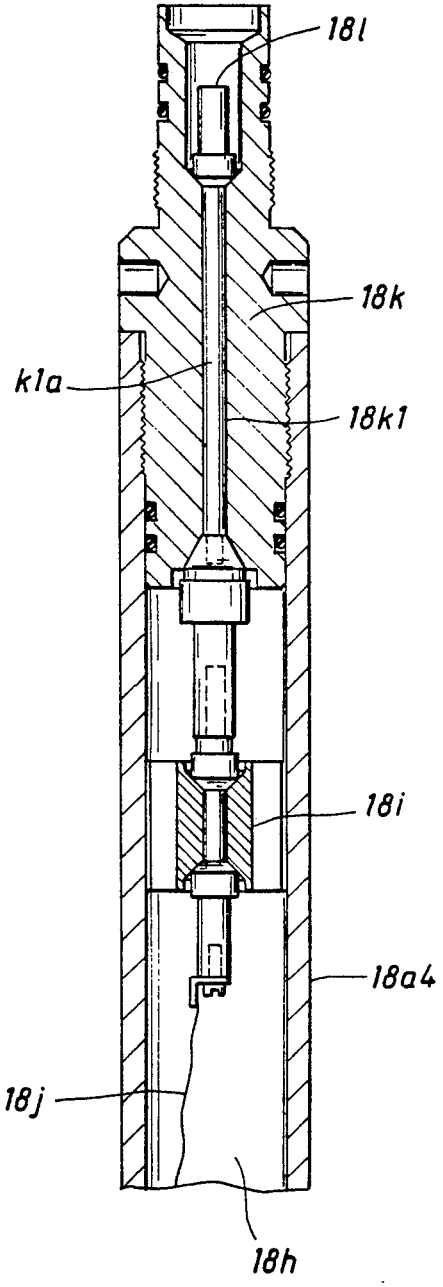

In FIG. *2c*, the other end of the first setting mandrel 18*b* includes an enlarged piston portion 18*b*4 forming a shoulder b4*a* at the point where the first setting mandrel 18*b* meets the enlarged piston portion 18*b*4. The setting housing 18*a* includes a first housing portion 18*a*1 and a second housing portion 18*a*2 threadedly connected to the first housing portion 18*a*1, a third housing portion 18*a*3 threadedly connected to the second housing portion 18*a*2, and a fourth housing portion 18*a*4 threadedly connected to the third housing portion 18*a*3. The end of the first housing portion 18*a*1 which is threadedly connected to the second housing portion 18*a*2 includes a thicker portion 18*a*1A, the thicker portion defining a first cavity 1A2 between the thicker portion 18*a*1A of the first housing portion 18*a*1 and the shoulder b4*a* of the enlarged portion 18*b*4 of the first setting mandrel 18*b* when the first housing portion 18*a*1 is threadedly connected to the second housing portion 18*a*2. A first pair of ports 1A1 are disposed through the thicker portion 18*a*1A of the first housing portion 18*a*1 thereby communicating the annulus section between the tool string of FIG. 1 and the casing 10*a* with the first cavity 1A2. Since the annulus section is filled with well fluid at hydrostatic pressure, this well fluid (at hydrostatic pressure) fills the pair of ports 1A1 and the first cavity 1A2 of the setting tool. A second setting mandrel 18*c* is disposed within the second housing portion 18a2 and is threadedly connected on one end to the enlarged piston portion 18b4 of the first setting mandrel 18b. An air chamber is defined between the second setting mandrel 18c and the second housing portion 18a2; as will be discussed in more detail below, the second setting mandrel 18c with surrounding air chamber provides extra upward force at low well annulus fluid hydrostatic pressure; and further such mandrels and housings may be connected as shown in FIG. 2c in order to increase the upward force as necessary depending upon the hydrostatic pressure of the well fluid within the annulus section. The second housing portion 18a2 also includes a thicker portion 18a2A (similar to the thicker portion 18a1A of the first housing portion). A further pair of ports 2A1 are disposed through the thicker portion 18a2A of the second housing portion 18a2. An oil piston 18d, having a deep bore, is disposed within one end of a third housing portion 18a3 and is threadedly connected on one end to the other end of the second setting mandrel 18c defining a shoulder 18d1 at the point where the other end of the second setting mandrel 18c meets the oil piston 18d. Since a second cavity 2A2 is defined between the shoulder 18d1 of the oil piston 18d and the thicker portion 18a2A of the second housing portion 18a2, the further pair of ports 2A1, disposed through the thicker portion 18a2A, each communicate the annulus section around the setting tool of FIG. 1 (filled with well fluid at hydrostatic pressure) with the second cavity 2A2 within the setting tool. A still further port 18d2 is disposed through the one end of the oil piston 18d, on one side only, communicating the cavity 2A2 with an inner surface of the third housing portion 18a3 and with the deep bore internal chamber 18d3 within the upper end of oil piston 18d.

Figure 2B:
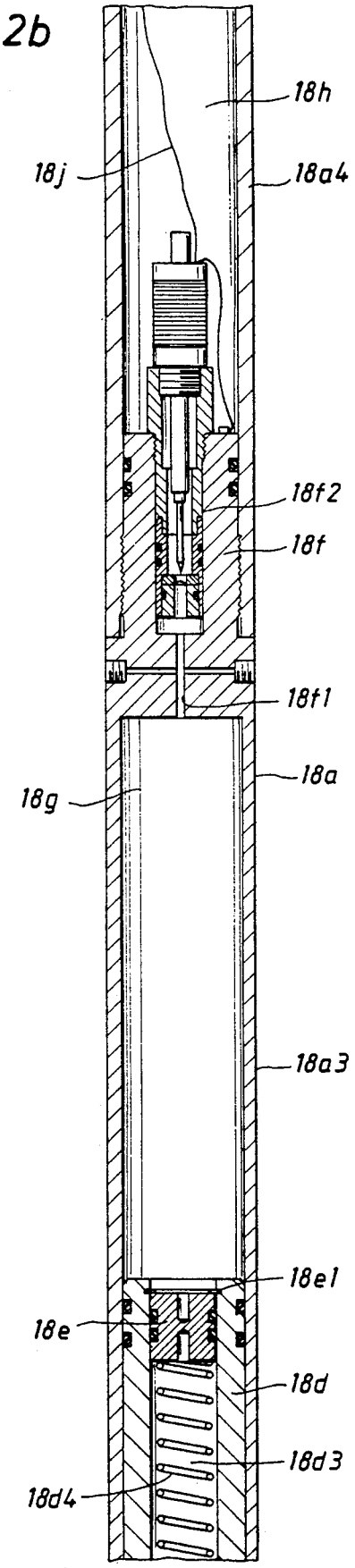
Figure 2C:
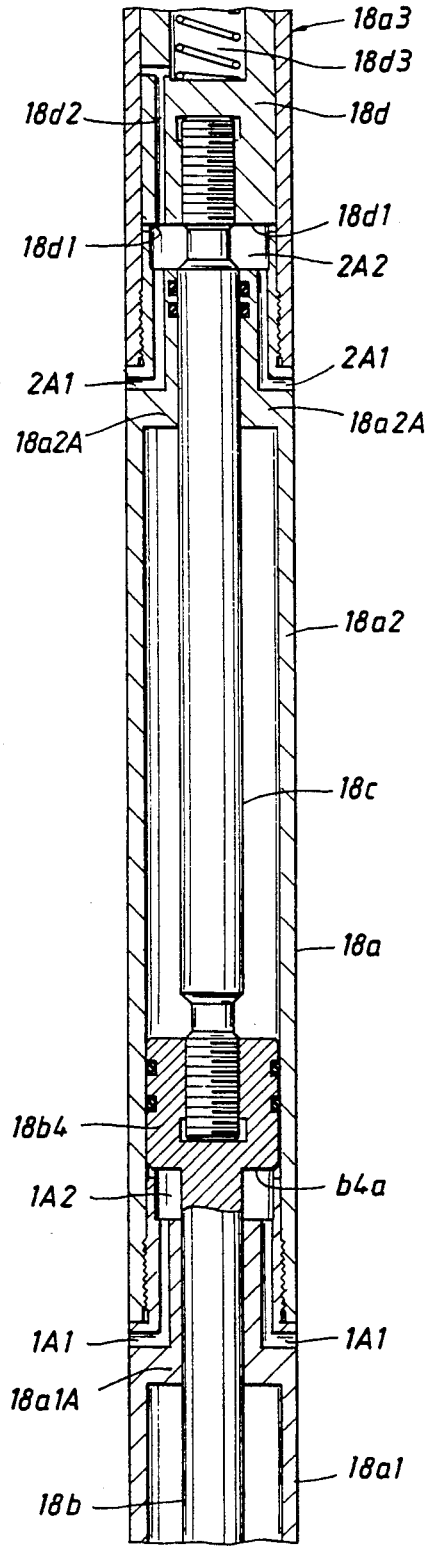

In FIG. 2b, as previously noted, the oil piston 18d contains a deep bore on its upper end thereby defining an internal chamber 18d3. An oil compensating piston 18e is disposed in sealing relationship within the internal chamber 18d3 at the other end of the oil piston 18d. The oil compensating piston 18e moves to compensate for oil volume changes in an oil chamber 18g due to changes in pressure and temperature. A spring 18d4 is disposed within the internal chamber 18d3 of the oil piston 18d biasing the oil compensating piston 18e, disposed at the other end of the internal chamber 18d3 of the oil piston 18d, against an internal retaining ring 18e1 disposed in the wall of chamber 18d3 at the one end of oil piston 18d thereby retaining the compensating piston 18e within internal chamber 18d3. In response to changes in pressure and temperature, the oil compensating piston 18e moves in opposition to the biasing force of spring 18d4 to compensate for the volume changes in the oil in oil chamber 18g resultant from the changes in pressure and temperature. An end part 18f of the third housing portion 18a3 is disposed diametrically across the setting tool 18 and functions like a first barrier that separates an oil chamber 18g within the third housing portion 18a3 from an air chamber 18h within the fourth housing portion 18a4. The oil chamber 18g is bounded on all sides by the oil compensating piston 18e, the end part 18f, and the third housing portion 18a3, the oil chamber 18g being filled with oil. However, the oil chamber 18g is filled with oil which is at hydrostatic pressure when the setting tool 18 is disposed downhole. An oil metering orifice 18f1 is disposed through the longitudinal center of the end part 18f of the third housing portion. The setting speed of the setting tool of this invention may be varied by adjusting the diameter of the orifice 18f1. A selectively operable apparatus 18f2 is disposed between the oil metering orifice 18f1 and air chamber 18h for initially maintaining the orifice 18f1 closed thereby preventing the oil in oil chamber 18g from moving through the oil metering orifice 18f1 and subsequently selectively allowing the oil to move through the oil metering orifice 18f1. In the preferred embodiment, the selectively operable apparatus 18f2 is a hydropuncture operator 18f2. The hydropuncture operator 18f2 will be described in detail below.

In FIG. 2a, the end part or first barrier 18f is disposed on one side of the air chamber 18h and an electric current feedthrough connector 18i is disposed at the other end of the air chamber 18h within the fourth housing portion 18a4. An electrical current carrying conductor 18j is interconnected between the connector 18i and the hydropuncture operator 18f2 of the end part or first barrier 18f which separates the third housing 18a3 from the fourth housing 18a4. A further end part or second barrier 18k is threadedly connected to the other end of fourth housing portion 18a4, the further end part, second barrier 18k including a central bore 18k1 disposed through the longitudinal center in which a further current carrying conductor k1a is disposed, the further current carrying conductor k1a interconnecting the feedthrough connector 18i to a top external electric power connection 18L of the setting tool 18. The top external power connection 18L is connected to the well surface via wireline cable for transmitting an electric power from the well surface to the connector 18i via conductor k1a and ultimately to the hydropuncture operator 18f2 via the conductor 18j.

Figure 2D:
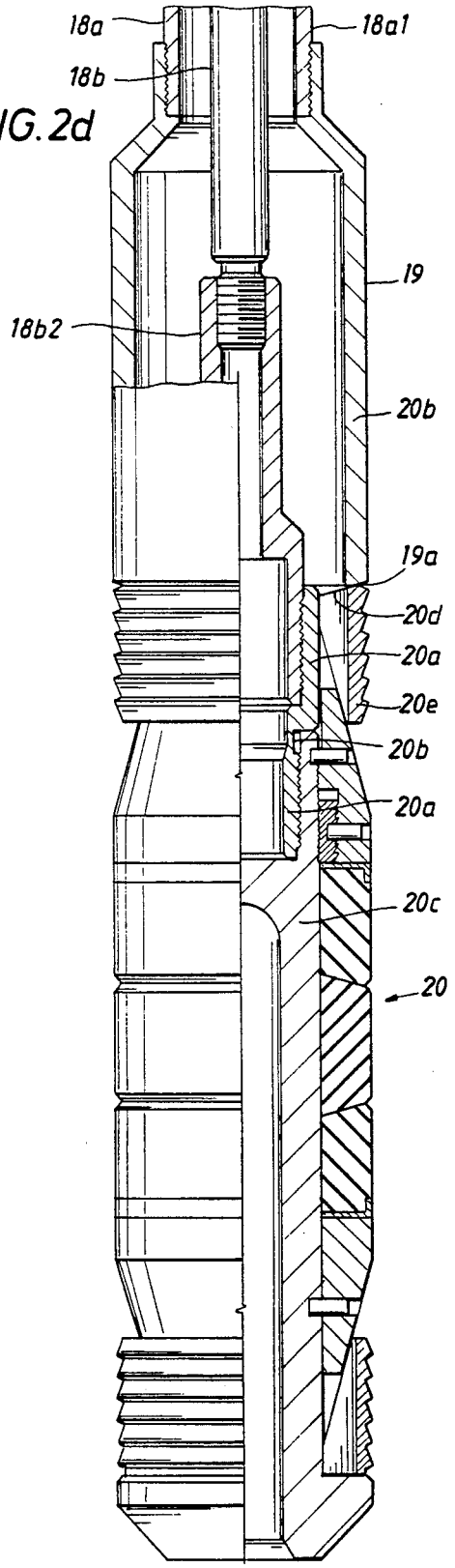

In FIG. 2d, the tension sleeve 20a is attached to the adaptor body 18b2, and threadedly to the first setting mandrel 18b. However, the tension sleeve 20a is threadedly connected to a setting mandrel 20c of the anchored device 20 via the recess portion 20b. A setting sleeve housing 19 is threadedly connected, on one end, to the first housing portion 18a1 of the setting tool 18. Setting sleeve housing 19 has a downwardly facing shoulder 19a which abuts an upwardly facing shoulder 20d on anchor slips 20e of anchored device 20. The tension sleeve 20a and setting adaptor 18b2 move upwardly in response to a corresponding movement of the first setting mandrel 18b and relative to setting sleeve housing 19 which remains stationary. Shoulder 19a of setting sleeve housing 19 contacts shoulder 20d of slips 20e. This movement of the setting mandrel 18b, setting adaptor 18b2, tension sleeve 20a and setting mandrel 20c expands the slips 20e of the anchored device 20 and anchors the anchored device 20 to an inner surface of the wellbore. When a predetermined force is applied to recess portion 20b of tension sleeve 20a, recess portion 20b shears off and separates thereby disconnecting setting tool 18 from anchored device 20.

Referring to FIG. 3, the hydropuncture operator 18f2 is threadedly connected to the upper end of end part (or first barrier) 18f and includes a puncture needle f2a (which includes solenoid plunger a1), a solenoid coil f2b disposed coaxially around the solenoid plunger a1, and a frangible rupture disc or diaphragm f2c which is adapted to be punctured by the puncture needle f2a when a D.C. current from conductor 18j flows through the solenoid coil f2b. The puncture needle f2a actually comprises a solenoid plunger a1 threadedly connected to an adaptor a2, the adaptor a2 being threadedly connected to the puncture needle f2a itself. A biasing spring f2g is disposed around the adaptor a2 of the needle f2a and functions to hold the needle f2a off the rupture disc f2c when the current is not flowing through the solenoid coil f2b. A ground wire 18j1 connects the solenoid coil f2b to ground potential. The rupture disc f2c is a frangible diaphragm; as long as the rupture disc f2c is intact and is not punctured by the puncture needle f2a, the rupture disc f2c seals off the oil metering orifice 18f1 thereby preventing any oil disposed in oil chamber 18g from transferring through the oil metering orifice 18f1 to the air chamber 18h. The rupture disc f2c is also designed to rupture when a predetermined pressure is imposed on the disc f2c. Accordingly, even if puncture needle f2a fails to puncture the rupture disc f2c, if the predetermined pressure is exerted on the disc f2c, the rupture disc f2c will rupture allowing oil in oil chamber 18g to transfer to air chamber 18h. In operation, referring to FIG. 3, when a sufficient D.C. current from conductor 18j is delivered to solenoid coil f2b, the puncture needle f2a is forced to move toward the rupture disc f2c. The puncture needle f2a will eventually puncture the rupture disc f2c. In the meantime, if sufficient hydrostatic pressure is placed on the oil compensating piston 18d by the well annulus fluid via ports 1A1 and 2A1, the oil compensating piston 18d moves upwardly in the wellbore thereby placing significant pressure on the oil in oil chamber 18g. As noted above, since the puncture needle f2a has punctured the rupture disc f2c, the oil in oil chamber 18g is allowed to flow into the orifice 18f1, and from the orifice 18f1 around the puncture needle f2a, through a hole f2j, and into the air chamber 18h along a path indicated by arrow f2k in FIG. 3.

A functional description of the hydrostatic setting tool 18 in accordance with the present invention will be set forth in the following paragraphs with reference to FIGS. 1, 2a-2d and 3 of the drawings.

The setting tool 18 is disposed in a wellbore filled with well annulus fluid at hydrostatic pressure as shown in FIG. 1. The well fluid enters the first pair of ports 1A1 and the further pair of ports 2A1 disposed through the thicker portions 18a1A and 18a2A of FIG. 2c. The well fluid, at hydrostatic pressure, enters first cavity 1A2 and second cavity 2A2 and imposes a force on shoulder b4a of enlarged portion 18b4 and shoulder 18d1 of the oil piston 18d thereby placing the hydrostatic pressure of such well fluid on the respective shoulders b4a and 18d1. This pressure tends to urge the first and second setting mandrels 18b and 18c and the oil piston 18d upwardly in FIG. 1. Recall that the mandrel 18b and setting adaptor 18b2 are connected to a tension sleeve 20a; that the tension sleeve 20a is connected to an anchored device 20; and that oil is disposed in oil chamber 18g. Wellbore hydrostatic pressure acting on shoulders 18d1 and b4a places a corresponding hydrostatic pressure on the oil in oil chamber 18g. Oil at hydrostatic pressure is disposed in the oil metering orifice 18f1, but the rupture disc or diaphragm f2c prevents the oil from traversing the full extent of the orifice 18f1. When temperature and pressure changes occur, the volume of the oil in oil chamber 18g may change; however, oil compensating piston 18e moves in opposition to the biasing force of spring 18d4 to maintain a constant hydrostatic pressure on the oil in oil chamber 18g. At this point, current is delivered from the well surface to the hydropuncture operator 18f2 via conductor 18j, feedthrough connector 18i, and conductor k1a. A current propagates through the solenoid coil f2b. An electromotive force, resulting from the current flowing in the coil f2b, moves the puncture needle f2a toward the rupture disc f2c. The needle f2a punctures the rupture disc f2a thereby allowing the oil, at hydrostatic pressure in oil chamber 18g, to move through the full extent of the oil metering orifice 18f1 and into the air chamber 18h. This movement of oil through the orifice 18f1 allows the first and second setting mandrels 18b and 18c to move further from upwardly in FIG. 2c, or upwardly in FIG. 1, until the anchored device 20 is anchored to the casing 10a. However, due to continued upward movement of the setting mandrels 18b and 18c, the tension sleeve 20a separates from the setting mandrel 20c of the anchored device 20, the separation occurring at the recess portion 20b.

In FIG. 4, another alternate embodiment of the selectively operable apparatus 18f2 disposed within the oil metering orifice 18f1 is illustrated.

In FIG. 4, the alternate embodiment of the selectively operable apparatus 18f2 comprises a piston f2d which includes a pair or o-rings d1 disposed within end part 18f, the end part 18f having an enlarged bore 18f3. One end of the piston f2d disposed adjacent the air chamber 18h includes a retaining ring f2e which is both soldered to and shouldered against the one end of the piston f2d, the solder and shoulder being disposed at point d2 in FIG. 4. The solder melts at approximately 400 degrees F. A heater element f2f surrounds the retaining ring f2e, the heater being capable of heating up to 800 degrees F. Insulation material f2h, designed to resist the transfer of heat, surrounds the retaining ring f2e. Additional insulation material f2i is also disposed within the piston f2d. The electrical conductor 18j is connected to the heater element f2f and receives electric power from the well surface, a current associated with this electric power flowing in and heating the heater element. The other end of the piston f2d is exposed to hydrostatic pressure of the oil in oil chamber 18g via oil metering orifice 18f1. However, since the piston f2d is both soldered to and shouldered against the retaining ring f2e, the piston f2d cannot move. In operation, in FIG. 4, when the current from the well surface is received by the heater element f2f via conductor 18j, the heater heats to approximately 800 degrees F. As a result, the retaining ring f2e also heats to this temperature. The solder, at d2, disposed between the retaining ring f2e and the piston f2d melts; however, even though the solder melted, the piston f2d still does not move because it is also shouldered, at d2, against the retaining ring f2e. Due to the heat within the retaining ring, however, the retaining ring f2e expands thereby releasing the piston f2d from the shoulder of the retaining ring f2e; the hydrostatic pressure of the oil in oil chamber 18g pushes the piston f2d from right to left of FIG. 4 thereby moving the o-rings d1 past the enlarged bore 18f3 of the end part 18f. Consequently, the oil the oil chamber 18g may now move past the piston f2d via the enlarged bore 18f3 into the air chamber 18h.

Referring to FIG. 5, still another alternate embodiment of the selectively operable apparatus 18f2 disposed within the oil metering orifice 18f1 is illustrated.

In FIG. 5, the alternate embodiment of the selectively operable apparatus 18f2 comprises a hex bolt f2L threadedly connected to the end part 18f of the third housing portion 18a3, a shape memory alloy element f2M disposed around the bolt f2L and interposed between a shoulder of the end part 18f of the third housing portion 18a3 and the head L1 of the bolt f2L, and an electric resistance heater f2N connected to wires 18*j* and wrapped around the shape memory alloy f2M. A recess L2 is disposed around the bolt f2L, the recess L2 being adapted to separate thereby splitting the bolt f2L into two parts when a sufficient longitudinally directed tension load is imposed on the bolt f2L. A hole L3 is disposed through the bolt f2L, the hole L3 being coextensive with the oil metering orifice 18*f*1 on the one end and extending past the recess L2 on the other end. The shape memory alloy f2M expands longitudinally when heat is applied thereto by the heater f2N thereby imposing the tension load on the bolt f2L. In operation, referring to FIG. 5, when a current is conducted through wires 18*j*, the heater f2N begins to apply heat to the shape memory alloy f2M. In response, the alloy f2M expands longitudinally thereby imposing a tension load on the bolt f2L. As a result of the tension load, the bolt separates along recess L2, splits apart into two pieces, and opens the hole L3. Before the bolt f2L splits apart, the hole L3, which is coextensive and communicates with orifice 18*f*1 on one end, is closed on the other end. After the bolt f2L splits apart along recess L2 in response to the tension load imposed thereon by the shape memory alloy f2M, the hole L3, disposed at the other end of the bolt, changes from a closed to an open condition thereby allowing the oil in chamber 18*g* to pass through orifice 18*f*1, through the open end of hole L3, and into the air chamber 18*h*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of anchoring a device in a wellbore, comprising the steps of:

transmitting an electrical signal thereby opening an orifice between a first chamber and a second chamber;

flowing an annulus fluid at hydrostatic pressure into a port of a housing and imposing the hydrostatic pressure of the annulus fluid on a surface of a mandrel;

when the orifice opens in response to the electrical signal, moving the mandrel in response to the hydrostatic pressure of the annulus fluid;

moving a piston in response to the movement of the mandrel;

transferring a fluid from said first chamber to said second chamber via said orifice in response to the movement of said piston; and anchoring said device during the transfer of said fluid from said first chamber to said second chamber.

2. A method of anchoring a device in a wellbore, comprising the steps of:

transmitting an electrical signal and opening an orifice between a first chamber and a second chamber in response to the electrical signal, the opening step including the steps of, propelling a needle into contact with a frangible member in response to the electrical signal, puncturing the frangible member by said needle thereby creating an opening in said frangible member, said orifice opening when the frangible member is punctured;

moving a piston in response to a hydrostatic pressure of an annulus fluid in the wellbore;

transferring a fluid from said first chamber to said second chamber via said orifice in response to the movement of said piston; and anchoring said device during the transfer of said fluid from said first chamber to said second chamber.

3. The method of claim 2, wherein a mandrel is interconnected between said device and said piston, further comprising the step of:

moving said mandrel in response to the hydrostatic pressure of said annulus fluid, the piston being moved in response to the movement of said mandrel, the fluid transferring to said second chamber when said electrical signal opens said orifice and said piston moves, the device being anchored during the movement of said mandrel and the movement of said piston.

4. The method of claim 3, wherein a housing is disposed around said mandrel and a port is disposed through the housing thereby allowing said annulus fluid to communicate with a surface of said mandrel via said port, further comprising the step of:

flowing said annulus fluid into said port and imposing the hydrostatic pressure of said annulus fluid on said surface of said mandrel, said mandrel moving when said electrical signal opens said orifice in response to said hydrostatic pressure of said annulus fluid on said surface of said mandrel.

5. A method of anchoring a device in a wellbore, comprising the steps of:

transmitting an electrical signal and opening an orifice between a first chamber and a second chamber in response to the electrical signal, the opening step including the steps of, applying a tension load to a member, said member including an internal bore and recess disposed around a peripery of said member, one end of said bore communicating with said orifice, the other end of said bore being disposed in a closed condition, separating said member along said recess in response to said tension load, the other end of said bore changing from said closed condition to an open condition when the member separates along said recess, the orifice opening when the other end of said bore changes to said open condition;

moving a piston in response to a hydrostatic pressure of an annulus fluid in the wellbore;

transferring a fluid from said first chamber to said second chamber via said orifice in response to the movement of said piston; and anchoring said device during the transfer of said fluid from said first chamber to said second chamber.

6. The method of claim 5, wherein a mandrel is interconnected between said device and said piston, further comprising the step of:

moving said mandrel in response to the hydrostatic pressure of said annulus fluid, the piston being moved in response to the movement of said mandrel, the fluid transferring to said second chamber when said electrical signal opens said orifice and said piston moves, the device being anchored during the movement of said mandrel and the movement of said piston.

7. The method of claim 6, wherein a housing is disposed around said mandrel and a port is disposed through the housing thereby allowing said annulus fluid to communicate with a surface of said mandrel via said port, further comprising the step of: flowing said annulus fluid into said port and imposing the hydrostatic pressure of said annulus fluid on said surface of said mandrel, said mandrel moving when said electrical signal opens said orifice in response to said hydrostatic pressure of said annulus fluid on said surface of said mandrel.

8. A method of anchoring a device in a wellbore, comprising the steps of:

transmitting an electrical signal and opening an orifice between a first chamber and a second chamber in response to the electrical signal, the opening step including the steps of, heating a ring, said ring initially holding a first piston in place, said orifice being closed by said first piston when said first piston is held in place by said ring, releasing said first piston in response to the heating of said ring, said orifice opening when said first piston is released;

moving a second piston in response to a hydrostatic pressure of an annulus fluid in the wellbore;

transferring a fluid from said first chamber to said second chamber via said orifice in response to the movement of said second piston; and anchoring said device during the transfer of said fluid from said first chamber to said second chamber.

9. A method of claim 8, wherein a mandrel is interconnected between said device and said second piston, further comprising the step of:

moving said mandrel in response to the hydrostatic pressure of said annulus fluid, the second piston being moved in response to the movement of said mandrel, the fluid transferring to said second chamber when said electrical signal opens said orifice and said second piston moves, the device being anchored during the movement of said mandrel and the movement of said second piston.

10. The method of claim 9, wherein a housing is disposed around said mandrel and a port is disposed through the housing thereby allowing said annulus fluid to communicate with a surface of said mandrel via said port, further comprising the step of:

flowing said annuls fluid into said port and imposing the hydrostatic pressure of said annulus fluid on said surface of said mandrel, said mandrel moving when said electrical signal opens said orifice in response to said hydrostatic pressure of said annulus fluid on said surface of said mandrel.

* * * * *